US010186276B2

(12) United States Patent
Dewasurendra et al.

(10) Patent No.: US 10,186,276 B2
(45) Date of Patent: Jan. 22, 2019

(54) ADAPTIVE NOISE SUPPRESSION FOR SUPER WIDEBAND MUSIC

(71) Applicant: QUALCOMM Incorporated, San Diego, CA (US)

(72) Inventors: Duminda Ashoka Dewasurendra, San Diego, CA (US); Vivek Rajendran, San Diego, CA (US); Subasingha Shaminda Subasingha, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 122 days.

(21) Appl. No.: 14/865,885

(22) Filed: Sep. 25, 2015

(65) Prior Publication Data

US 2017/0092288 A1 Mar. 30, 2017

(51) Int. Cl.

| | |
|---|---|
| ***G10L 21/02*** | (2013.01) |
| ***G10L 21/0208*** | (2013.01) |
| ***G10L 19/20*** | (2013.01) |
| ***G10L 19/26*** | (2013.01) |
| ***G10L 25/81*** | (2013.01) |

(Continued)

(52) U.S. Cl.

CPC ..... *G10L 21/0208* (2013.01); *G10L 19/20* (2013.01); *G10L 19/265* (2013.01); *G10L 25/81* (2013.01); *G10L 25/84* (2013.01); *H04R 1/08* (2013.01); *G10L 2021/02087* (2013.01); *H04R 2430/20* (2013.01)

(58) Field of Classification Search

CPC ..... G10L 21/0208; G10L 25/78; G10L 25/81

See application file for complete search history.

(56) References Cited

U.S. PATENT DOCUMENTS 5,848,163 A * 12/1998 Gopalakrishnan ..... G10L 21/0208 381/56

6,453,285 B1 * 9/2002 Anderson ..... G10L 25/78 381/94.3

7,174,291 B2 2/2007 McArthur et al.

(Continued)

OTHER PUBLICATIONS

International Search Report and Written Opinion from International Application PCT/US2016/044291, dated Oct. 19, 2016, 14 pp.

(Continued)

*Primary Examiner* — Jialong He

(74) *Attorney, Agent, or Firm* — Shumaker & Sieffert, P.A.

(57) ABSTRACT

Techniques are described for performing adaptive noise suppression to improve handling of both speech signals and music signals at least up to super wideband (SWB) bandwidths. The techniques include identifying a context or environment in which audio data is captured, and adaptively changing a level of noise suppression applied to the audio data prior to bandwidth compressing (e.g., encoding) based on the context. For a valid speech context, an audio pre-processor may set a first level of noise suppression that is relatively aggressive in order to suppress noise (including music) in the speech signals. For a valid music context, the audio pre-processor may set a second level of noise suppression that is less aggressive in order to leave the music signals undistorted. In this way, a vocoder at a transmitter side wireless communication device may properly encode both speech and music signals with minimal distortions.

24 Claims, 4 Drawing Sheets

(51) Int. Cl.
*H04R 1/08* (2006.01)
*G10L 25/84* (2013.01)

(56) References Cited

U.S. PATENT DOCUMENTS 7,209,567 B1* 4/2007 Kozel ..... H04R 3/007 381/94.3
7,454,010 B1* 11/2008 Ebenezer ..... G10L 21/0208 379/392.01
7,558,729 B1 7/2009 Benyassine et al.
7,844,452 B2* 11/2010 Takeuchi ..... G10L 21/02 704/217
8,718,290 B2* 5/2014 Murgia ..... G10K 11/16 381/71.1
8,949,120 B1* 2/2015 Every ..... G10L 21/0208 704/226
9,196,249 B1* 11/2015 Konchitsky ..... G10L 15/22
2002/0161576 A1* 10/2002 Benyassine ..... G10L 19/18 704/229
2005/0055116 A1* 3/2005 Isaka ..... G10L 19/18 700/94
2005/0091049 A1* 4/2005 Yang ..... G10L 21/0208 704/226
2006/0136203 A1* 6/2006 Ichikawa ..... G10L 21/0208 704/226
2007/0136053 A1* 6/2007 Ebenezer ..... G10H 1/0058 704/208
2008/0162121 A1* 7/2008 Son ..... G10L 19/22 704/201
2008/0175408 A1 7/2008 Mukund et al.
2008/0189104 A1* 8/2008 Zong ..... G10L 21/02 704/226
2008/0247577 A1* 10/2008 Dressler ..... H04R 25/505 381/317
2008/0317259 A1* 12/2008 Zhang ..... G10L 15/04 381/92
2009/0012783 A1* 1/2009 Klein ..... G10L 21/0208 704/226
2009/0012786 A1* 1/2009 Zhang ..... G10L 21/0208 704/233
2009/0164212 A1* 6/2009 Chan ..... G10L 21/0208 704/226
2009/0187409 A1* 7/2009 Krishnan ..... G10L 19/22 704/262
2009/0271187 A1* 10/2009 Yen ..... G10L 21/0208 704/226
2010/0081487 A1 4/2010 Chen et al.
2011/0112831 A1* 5/2011 Sorensen ..... G10L 19/012 704/226
2011/0178795 A1* 7/2011 Bayer ..... G10L 19/002 704/205
2011/0206198 A1* 8/2011 Freedman ..... G06Q 30/06 379/265.03
2011/0288860 A1* 11/2011 Schevciw ..... G10L 25/78 704/233
2011/0305345 A1* 12/2011 Bouchard ..... G10L 21/0208 381/23.1
2012/0027218 A1* 2/2012 Every ..... G10L 21/0208 381/66
2012/0078397 A1 3/2012 Lee et al.
2013/0013316 A1 1/2013 Burke et al.
2013/0022223 A1* 1/2013 Kehtarnavaz ..... H04R 25/70 381/317
2013/0090926 A1* 4/2013 Grokop ..... G10L 15/08 704/243
2013/0185063 A1* 7/2013 Atti ..... G10L 17/02 704/219
2013/0223660 A1* 8/2013 Olafsson ..... H04R 25/407 381/313
2013/0226572 A1* 8/2013 Mason ..... G10L 21/0208 704/226
2013/0282373 A1 10/2013 Visser et al.
2013/0332157 A1* 12/2013 Iyengar ..... G10L 15/20 704/233
2014/0046659 A1* 2/2014 Burton ..... G10L 25/48 704/226
2014/0072133 A1* 3/2014 Nicholson ..... H04M 1/605 381/71.6
2014/0235192 A1* 8/2014 Purnhagen ..... G10L 19/008 455/296
2014/0247945 A1 9/2014 Ramo et al.
2014/0337021 A1* 11/2014 Kim ..... G10L 21/0208 704/228
2015/0118961 A1* 4/2015 Petit ..... H04W 4/008 455/41.1
2015/0179184 A1* 6/2015 Cudak ..... G10L 21/0208 704/233
2016/0086618 A1* 3/2016 Neoran ..... H04M 9/08 704/205
2016/0125869 A1* 5/2016 Kulavik ..... G10K 11/178 381/71.6
2016/0133269 A1* 5/2016 Dusan ..... G10L 15/20 704/233

OTHER PUBLICATIONS

Jarvinen, et al., "Media Coding for the Next Generation Mobile System LTE," Computer Communications, Oct. 2010, Available online Apr. 18, 2010; vol. 33, pp. 1916-1927.
Song, et al., "Analysis and Improvement of Speech/Music Classification for 3GPP2 SMV Based on GMM", IEEE Signal Processing Letters, Jan. 4, 2008, vol. 15, pp. 103-106.
Malenovsky, et al., "Two-Stage Speech/Music Classifier with Decision Smoothing and Sharpening in the EVS Codec," International Conference on Acoustics, Speech and Signal Processing (ICASSP) 2015, Brisbane, Australia, Apr. 19-24, 2015, 5 pp.
Response to Written Opinion filed Jul. 25, 2017 in International Application No. PCT/US2016/044291, 4 pp.
International Preliminary Report on Patentability from International Application No. PCT/US2016/044291, dated Jan. 5, 2018, 14 pp.
Second Written Opinion from International Application No. PCT/US2016/044291, dated Aug. 29, 2017, 10 pp.
Al-Shoshan, et al., "A Three-Level Speech, Music, and Mixture Classifier," J. King Saud Univ., vol. 16, Eng. Sci. (2), pp. 319-333, Riyadh (A.H. 1424/2004).

* cited by examiner

ADAPTIVE NOISE SUPPRESSION FOR SUPER WIDEBAND MUSIC

TECHNICAL FIELD

The disclosure relates to audio signal processing and, more specifically, applying noise suppression to audio signals.

BACKGROUND

Wireless communication devices (e.g., mobile phones, smart phones, smart pads, laptops, tablets, etc.) may be used in noisy environments. For example, a mobile phone may be used at a concert, bar, or restaurant where environmental, background, or ambient noise introduced at a transmitter side reduces intelligibility and degrades speech quality at a receiver side. Wireless communication devices, therefore, typically incorporate noise suppression in a transmitter side audio pre-processor in order to reduce noise and clean-up speech signals before presenting the speech signals to a vocoder for coding and transmission.

In the case where a user is talking on a transmitter side wireless communication device amidst music, or in the case where the user is attempting to capture the music itself for transmission to a receiver side device, the noise suppression treats the music signals as noise to be eliminated in order to improve intelligibility of any speech signals. The music signals, therefore, are suppressed and distorted by the noise suppression prior to bandwidth compression (e.g., encoding) and transmission such that a listener at the receiver side will hear a low quality recreation of the music signals at the transmitter side.

SUMMARY

In general, this disclosure describes techniques for performing adaptive noise suppression to improve handling of both speech signals and music signals at least up to super wideband (SWB) bandwidths. The disclosed techniques include identifying a context or environment in which audio data is captured, and adaptively changing a level of noise suppression applied to the audio data prior to bandwidth compression (e.g., encoding) of the audio data based on the context. In the case that the audio data has a valid speech context (i.e., the user intends to primarily transmit speech signals), an audio pre-processor may set a first level of noise suppression that is relatively aggressive in order to suppress noise (including music) in the speech signals. In the case that the audio data has a valid music context (i.e., the user intends to primarily transmit music signals or both music and speech signals), the audio pre-processor may set a second level of noise suppression that is less aggressive in order to leave the music signals undistorted. In this way, a vocoder at a transmitter side wireless communication device may properly compress or encode both speech and music signals with minimal distortions.

In one example, this disclosure is directed to a device configured to provide voice and data communications, the device comprising one or more processors configured to obtain an audio context of input audio data, prior to application of a variable level of noise suppression to the input audio data, wherein the input audio data includes speech signals, music signals, and noise signals; apply the variable level of noise suppression to the input audio data prior to bandwidth compression of the input audio data with an audio encoder based on the audio context; and bandwidth compress the input audio data to generate at least one audio encoder packet. The device further comprising a memory, electrically coupled to the one or more processors, configured to store the at least one audio encoder packet, and a transmitter configured to transmit the at least one audio encoder packet.

In another example, this disclosure is directed to an apparatus capable of noise suppression comprising means for obtaining an audio context of input audio data, prior to application of a variable level of noise suppression to the input audio data, wherein the input audio data includes speech signals, music signals, and noise signals; means for applying a variable level of noise suppression to the input audio data prior to bandwidth compression of the input audio data with an audio encoder based on the audio context; means for bandwidth compressing the input audio data to generate at least one audio encoder packet; and means for transmitting the at least one audio encoder packet.

In a further example, this disclosure is directed to a method used in voice and data communications comprising obtaining an audio context of input audio data, during a conversation between a user of a source device and a user of a destination device, wherein music is playing in a background of the user of the source device, prior to application of a variable level of noise suppression to the input audio data from the user of the source device, and wherein the input audio data includes a voice of the user of the source device and the music playing in the background of the user of the source device; applying a variable level of noise suppression to the input audio data prior to bandwidth compression of the input audio data with an audio encoder based on the audio context including the audio context being speech or music, or both speech and music; bandwidth compressing the input audio data to generate at least one audio encoder packet, and transmitting the at least one audio encoder packet from the source device to the destination device.

The details of one or more aspects of the techniques are set forth in the accompanying drawings and the description below. Other features, objects, and advantages of the techniques will be apparent from the description and drawings, and from the claims.

DETAILED DESCRIPTION

This disclosure describes techniques for performing adaptive noise suppression to improve handling of both speech signals and music signals at least up to super wideband (SWB) bandwidths. Conventional noise suppression units included in audio pre-processors of wireless communication device are configured to compress any non-speech signals as noise in order to improve intelligibility of speech signals to be encoded. This style of noise suppression works well with vocoders configured to operate according to traditional speech codecs, such as adaptive multi-rate (AMR) or adaptive multi-rate wideband (AMRWB). These traditional speech codecs are capable of coding (i.e., encoding or decoding) speech signals at low bandwidths, e.g., using algebraic code-excited linear prediction (ACELP), but are not capable of coding high quality music signals. The recently standardized Enhanced Voice Services (EVS) codec is capable of coding speech signals as well as music signals up to super wideband bandwidths (i.e., 0-16 kHz) or even full band bandwidths (i.e., 0-24 kHz). Conventional noise suppression units, however, continue to suppress and distort music signals prior to encoding.

The techniques described in this disclosure include identifying a context or environment in which audio data (speech, music, or speech and music) is captured, and adaptively changing a level of noise suppression applied to the audio data prior to encoding of audio data based on the context. For example, in accordance with the disclosed techniques, a wireless communication device may include one or more of a speech-music (SPMU) classifier, a proximity sensor, or other detectors within a transmitter side audio pre-processor used to determine whether the audio data is captured in either a valid speech context or a valid music context.

In the case that the audio data has a valid speech context (i.e., the user intends to primarily transmit speech signals to engage in a conversation with a listener), the audio pre-processor may set a first level of noise suppression that is relatively aggressive in order to suppress noise (including music) before passing the speech signals to a vocoder for coding and transmission. In the case that the audio data has a valid music context (i.e., the user intends to primarily transmit music signals or both music and speech signals for a listener to experience), the audio pre-processor may set a second level of noise suppression that is less aggressive to allow undistorted music signals to pass to a vocoder for coding and transmission. In this way, a vocoder configured to operate according to the EVS codec at the transmitter side wireless communication device may properly encode both speech and music signals to enable complete recreation of an audio scene at a receiver side device with minimal distortions to SWB music signals.

Figure 1:
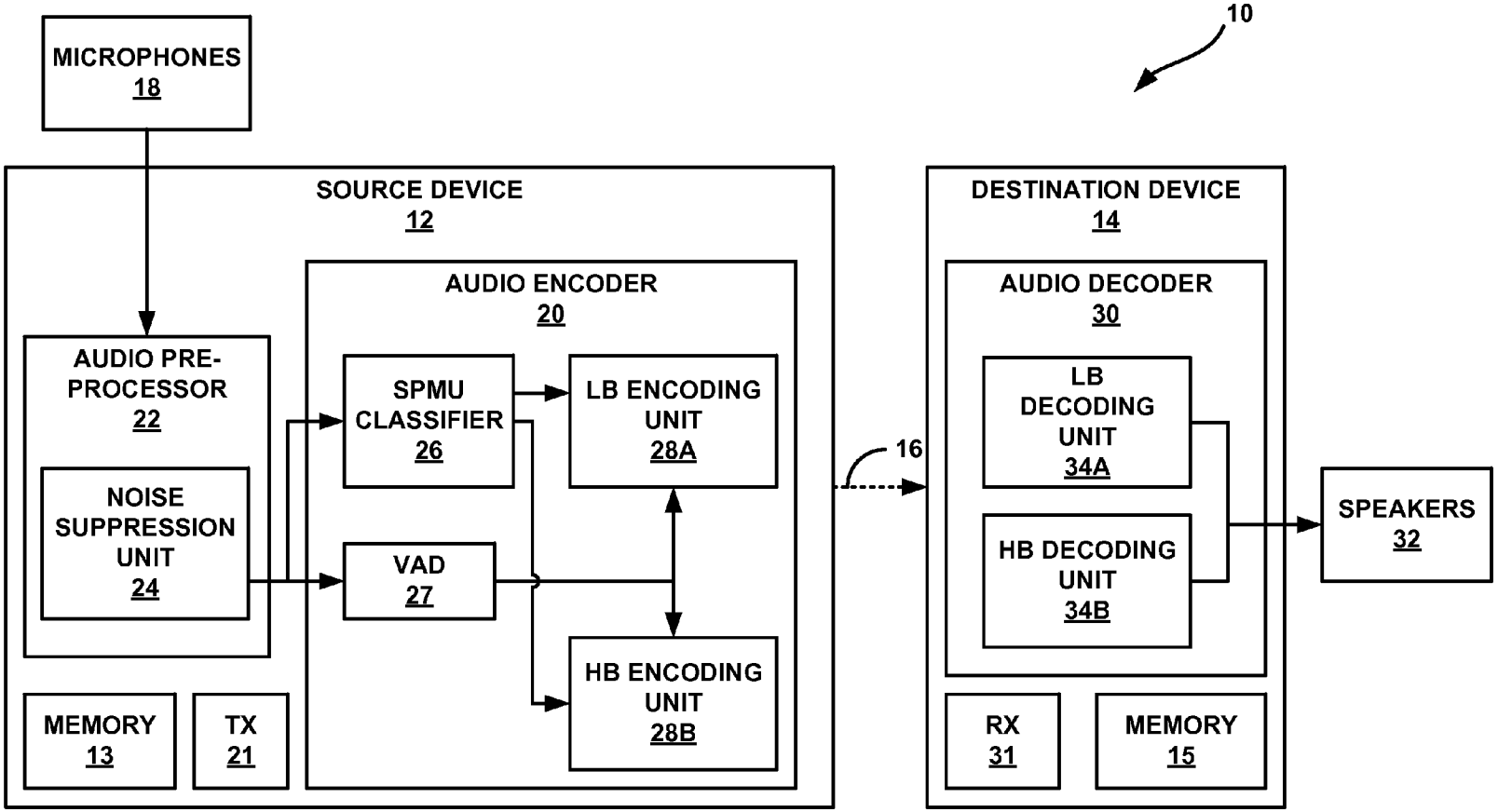
FIG. 1 is a block diagram illustrating an example audio encoding and decoding system 10 that may utilize techniques described in this disclosure.

FIG. 1 is a block diagram illustrating an example audio encoding and decoding system 10 that may utilize techniques described in this disclosure. As shown in FIG. 1, system 10 includes a source device 12 that provides encoded audio data to be decoded at a later time by a destination device 14. In particular, source device 12 includes a transmitter (TX) 21 used to transmit the audio data to a receiver (RX) 31 included in destination device 14 via a computer-readable medium 16. Source device 12 and destination device 14 may comprise any of a wide range of devices, including desktop computers, notebook (i.e., laptop) computers, tablet computers, set-top boxes, mobile telephone handsets such as so-called "smart" phones, so-called "smart" pads, televisions, cameras, display devices, digital media players, video gaming consoles, video streaming devices, audio streaming devices, wearable devices, or the like. In some cases, source device 12 and destination device 14 may be equipped for wireless communication.

Destination device 14 may receive the encoded audio data to be decoded via computer-readable medium 16. Computer-readable medium 16 may comprise any type of medium or device capable of moving the encoded audio data from source device 12 to destination device 14. In one example, computer-readable medium 16 may comprise a communication medium to enable source device 12 to transmit encoded audio data directly to destination device 14 in real-time. The encoded audio data may be modulated according to a communication standard, such as a wireless communication protocol, and transmitted to destination device 14. The communication medium may comprise any wireless or wired communication medium, such as a radio frequency (RF) spectrum or one or more physical transmission lines. The communication medium may form part of a packet-based network, such as a local area network, a wide-area network, or a global network such as the Internet. The communication medium may include routers, switches, base stations, or any other equipment that may be useful to facilitate communication from source device 12 to destination device 14.

In some examples, encoded audio data may be output from source device 12 to a storage device (not shown). Similarly, encoded audio data may be accessed from the storage device by destination device 14. The storage device may include any of a variety of distributed or locally accessed data storage media such as a hard drive, Blu-ray discs, DVDs, CD-ROMs, flash memory, volatile or non-volatile memory, or any other suitable digital storage media for storing encoded audio data. In a further example, the storage device may correspond to a file server or another intermediate storage device that may store the encoded audio generated by source device 12. Destination device 14 may access stored audio data from the storage device via streaming or download. The file server may be any type of server capable of storing encoded audio data and transmitting that encoded audio data to the destination device 14. Example file servers include a web server (e.g., for a website), an FTP server, network attached storage (NAS) devices, or a local disk drive. Destination device 14 may access the encoded audio data through any standard data connection, including an Internet connection. This may include a wireless channel (e.g., a Wi-Fi connection), a wired connection (e.g., DSL, cable modem, etc.), or a combination of both that is suitable for accessing encoded audio data stored on a file server. The transmission of encoded audio data from the storage device may be a streaming transmission, a download transmission, or a combination thereof.

The illustrated system 10 of FIG. 1 is merely one example. Techniques for processing audio data may be performed by any digital audio encoding or decoding device. Although generally the techniques of this disclosure are performed by an audio pre-processor, the techniques may also be performed by an audio encoding device or an audio encoder/decoder, typically referred to as a "codec" or "vocoder." Source device 12 and destination device 14 are merely examples of such coding devices in which source device 12 generates coded audio data for transmission to destination device 14. In some examples, devices 12, 14 may operate in a substantially symmetrical manner such that each of devices 12, 14 include audio encoding and decoding components. Hence, system 10 may support one-way or two-way audio transmission between devices 12, 14, e.g., for audio streaming, audio playback, audio broadcasting, or audio telephony.

In the example of FIG. 1, source device 12 includes microphones 18, audio pre-processor 22, and audio encoder 20. Destination device 14 includes audio decoder 30 and speakers 32. In other examples, source device 12 may also include its own audio decoder and destination device 14 may also include its own audio encoder. In the illustrated example, source device 12 receives audio data from one or more external microphones 18 that may comprise a microphone array configured to capture input audio data. Likewise, destination device 14 interfaces with one or more external speakers 32 that may comprise a speaker array. In other examples, a source device and a destination device may include other components or arrangements. For example, source device 12 may receive audio data from an integrated audio source, such as one or more integrated microphones. Likewise, destination device 14 may output audio data to an integrated audio output device, such as one or more integrated speakers.

In some examples, microphones 18 may be physically coupled to source device 12, or may be wirelessly communicating with source device 12. To illustrate the wireless communication with source device 12, FIG. 1 shows microphones 18 outside of source device 12. In other examples, microphones 18 may have been also shown inside source device 12 to illustrate the physical coupling of source device 12 to microphones 18. Similarly, speakers 32 may be physically coupled to destination device 14, or may be wirelessly communicating with destination device 14. To illustrate the wireless communication with destination device 14, FIG. 1 shows speakers 32 outside of destination device 14. In other examples, speakers 32 may have been also shown inside destination device 14 to illustrate the physical coupling of destination device 14 to speakers 32.

In some examples, Microphones 18 of source device 12 may include at least one microphone integrated into source device 12. In one example where source device 12 comprises a mobile phone, microphones 18 may include at least a "front" microphone positioned near a user's mouth to pick up the user's speech. In another example where source device 12 comprises a mobile phone, microphones 18 may include both a "front" microphone positioned near a user's mouth and a "back" microphone positioned at a backside of the mobile phone to pick up environmental, background, or ambient noise. In a further example, microphones 18 may comprise an array of microphones integrated into source device 12. In other examples, source device 12 may receive audio data from one or more external microphones via an audio interface, retrieve audio data from a memory or audio archive containing previously captured audio, or generate audio data itself. The captured, pre-captured, or computer-generated audio may be bandwidth compressed and encoded by audio encoder 20. The encoded audio data in at least one audio encoder packet may then be transmitted by TX 21 of source device 12 onto a computer-readable medium 16.

Computer-readable medium 16 may include transient media, such as a wireless broadcast or wired network transmission, or storage media (that is, non-transitory storage media), such as a hard disk, flash drive, compact disc, digital video disc, Blu-ray disc, or other computer-readable media. In some examples, a network server (not shown) may receive encoded audio data from source device 12 and provide the encoded audio data to destination device 14. e.g., via network transmission. Similarly, a computing device of a medium production facility, such as a disc stamping facility, may receive encoded audio data from source device 12 and produce a disc containing the encoded audio data. Therefore, computer-readable medium 16 may be understood to include one or more computer-readable media of various forms, in various examples.

Destination device 14 may receive, with RX 31, the encoded audio data in the at least one audio encoder packet from computer-readable medium 16 for decoding by audio decoder 30. Speakers 32 playback the decoded audio data to a user. Speakers 32 of destination device 14 may include at least one speaker integrated into destination device 14. In one example where destination device 14 comprises a mobile phone, speakers 32 may include at least a "front" speaker positioned near a user's ear for use as a traditional telephone. In another example where destination device 14 comprises a mobile phone, speakers 32 may include both a "front" speaker positioned near a user's ear and a "side" or "back" speaker positioned elsewhere on the mobile phone to facilitate use as a speaker phone. In a further example, speakers 32 may comprise an array of speakers integrated into destination device 14. In other examples, destination device 14 may send decoded audio data for playback on one or more external speakers via an audio interface. In this way, destination device 14 includes at least one of speakers 32 configured to render an output of audio decoder 30 configured to decode the at least one audio encoder packet received by destination device 14.

Audio encoder 20 and audio decoder 30 each may be implemented as any of a variety of suitable encoder circuitry, such as one or more microprocessors, digital signal processors (DSPs), application specific integrated circuits (ASICs), field programmable gate arrays (FPGAs), discrete logic, software, hardware, firmware or any combinations thereof. When the techniques are implemented partially in software, a device may store instructions for the software in a suitable, non-transitory computer-readable medium and execute the instructions in hardware using one or more processors to perform the techniques of this disclosure. Each of audio encoder 20 and audio decoder 30 may be included in one or more encoders or decoders, either of which may be integrated as part of a combined encoder/decoder (codec or vocoder) in a respective device.

In addition, source device 12 includes memory 13 and destination device 14 includes memory 15 configured to store information during operation. The integrated memory may include a computer-readable storage medium or computer-readable storage device. In some examples, the integrated memory may include one or more of a short-term memory or a long-term memory. The integrated memory may include, for example, random access memory (RAM), dynamic random access memory (DRAM), static random access memory (SRAM), magnetic hard discs, optical discs, floppy discs, flash memory, or forms of electrically programmable memory (EPROM) or electrically erasable and programmable memory (EEPROM). In some examples, the integrated memory may be used to store program instructions for execution by one or more processors. The integrated memory may be used by software or applications running on each of source device 12 and destination device 14 to temporarily store information during program execution.

In this way, source device 12 includes memory 13 electrically coupled to one or more processors and configured to store the at least one audio encoder packet, and transmitter 21 configured to transmit the at least one audio encoder packet over the air. As used herein, "coupled" may include "communicatively coupled," "electrically coupled," or "physically coupled," and combinations thereof. Two devices (or components) may be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled may be included in the same device or in different devices and may be connected via electronics, one or more connectors, or inductive coupling, as illustrative, non-limiting examples. In some implementations, two devices (or components) that are communicatively coupled, such as in electrical communication, may send and receive electrical signals (digital signals or analog signal) directly or indirectly, such as via one or more wires, buses, networks, etc. For example, memory 13 may be in electrical communication with the one or more processors of source device 12, which may include audio encoder 20 and pre-processor 22 executing noise suppression unit 24. As another example, memory 15 may be in electrically coupled to one or more processors of destination device 14, which may include audio decoder 30.

In some examples, source device 12 and destination device 14 are mobile phones that may be used in noisy environments. For example, source device 12 may be used at a concert, bar, or restaurant where environmental, background, or ambient noise introduced at source device 12 reduces intelligibility and degrades speech quality at destination device 14. Source device 12, therefore, includes a noise suppression unit 24 within audio pre-processor 22 in order to reduce noise and improve (or, in other words, clean-up) speech signals before presenting the speech signals to audio encoder 20 for bandwidth compression, coding, and transmission to destination device 14.

In general, noise suppression is a transmitter side technology that is used to suppress background noise captured by a microphone while a user is speaking in a transmitter side environment. Noise suppression should not be confused with active noise cancellation (ANC), which is a receiver side technology that is used to cancel any noise encountered in the receiver side environment. Noise suppression is performed during pre-processing at the transmitter side in order to prepare captured audio data for encoding. That is, noise suppression may reduce noise to permit more efficient compression to be achieved during encoding that results in smaller (in term of size) encoded audio data in comparison to encoded audio data that has not been pre-processed using noise suppression. As such, noise suppression is not performed within audio encoder 20, but instead is performed in audio pre-processor 22 and the output of noise suppression in audio pre-processor 22 is the input to audio encoder 20, sometimes with other minor processing in between.

Noise suppression may operate in narrowband (NB) (i.e., 0-4 kHz), wideband (WB) (i.e., 0-7 kHz), super wideband (SWB) (i.e., 0-16 kHz) or full band (FB) (i.e., 0-24 kHz) bandwidths. For example, if the input audio data to noise suppression is SWB content, the noise suppression may process the audio data to suppress noise in all frequencies in the range 0-16 kHz, and the intended output is clean speech signals in the range 0-16 kHz. If the input audio data bandwidth is high, e.g., FB bandwidth, a fast Fourier transform (FFT) of the noise suppression may split the input audio data into more frequency bands and post processing gains may be determined and applied for each of the frequency bands. Later, an inverse FFT (IFFT) of the noise suppression may combine the audio data split among the frequency bands into a single output signal of the noise suppression.

In the case where a user is talking on source device 12 amidst music, or in the case where the user is attempting to capture the music itself for transmission to destination device 14, conventional noise suppression during audio pre-processing treats the music signals as noise to be eliminated in order to improve intelligibility of the speech signals. The music signals, therefore, are suppressed and distorted by the conventional noise suppression prior to encoding and transmission such that a user listening at destination device 14 will hear a low quality recreation of the music signals.

Conventional noise suppression works well with vocoders configured to operate according to traditional speech codecs, such as adaptive multi-rate (AMR) or adaptive multi-rate wideband (AMRWB). These traditional speech codecs are capable of coding (i.e., encoding or decoding) speech signals at low bandwidths, e.g., using algebraic code-excited linear prediction (ACELP), but are not capable of coding high quality music signals. For example, the AMR and AMRWB codecs do not classify incoming audio data as speech content or music content, and encode accordingly. Instead, the AMR and AMRWB codecs treat all non-noise signals as speech content and codes the speech content using ACELP. The quality of music coded according to the AMR or AMRWB codecs, therefore, is poor. In addition, the AMR codec is limited to audio data in the narrowband (NB) bandwidth (i.e., 0-4 kHz) and the AMRWB codec is limited to audio signals in the wideband (WB) bandwidth (i.e., 0-7 kHz). Most music signals, however, include significant content above 7 kHz, which is discarded by the AMR and AMRWB codecs.

The recently standardized Enhanced Voice Services (EVS) codec is capable of coding speech signals as well as music signals up to super wideband (SWB) bandwidths (i.e., 0-16 kHz) or even full band (FB) bandwidths (i.e., 0-24 kHz). In general, other codecs exist that are capable of coding music signals, but these codecs are not used or intended to also code conversational speech in a mobile phone domain (e.g., Third Generation Partnership Project (3GPP)), which require low delay operation. The EVS codec is a low delay conversational codec that can also code in-call music signals at high quality (e.g., SWB or FB bandwidths).

The EVS codec, therefore, offers users the capability of transmitting music signals within a conversation, and recreating a rich audio scene present at a transmitter side device, e.g., source device 12, at a receiver side device, i.e., destination device 14. Conventional noise suppression during audio pre-processing, however, continues to suppress and distort music signals prior to encoding. Even in the case where the captured audio data includes primary music signals at high signal-to-noise ratio (SNR) levels rather than in the background, the music signals are highly distorted by the conventional noise suppression.

In the example of FIG. 1, audio encoder 20 of source device 12 and audio decoder 30 of destination device 14 are configured to operate according to the EVS codec. In this way, audio encoder 20 may fully encode SWB or FB music signals at source device 12, and audio decoder 30 may properly reproduce SWB or FB music signals at destination device 14. As illustrated in FIG. 1, audio encoder 20 includes a speech-music (SPMU) classifier 26, a voice activity detector (VAD) 27, a low band (LB) encoding unit 28A and a high band (HB) encoding unit 28B. Audio encoder 20 performs encoding in two parts by separately encoding a low band (0-8 kHz) portion of the audio data using LB encoding unit 28A and a high band (8-16 kHz or 8-24 kHz) using HB encoding unit 28B depending on the available of content in these bands.

At audio encoder 20, VAD 27 may provide an output as a 1 when the input audio data includes speech content, and provide an output as a 0 when the input audio data includes non-speech content (such as music, tones, noise, etc.). SPMU classifier 26 determines whether audio data input to audio encoder 20 includes speech content, music content, or both speech and music content. Based on this determination, audio encoder 20 selects the best LB and HB encoding methods for the input audio data. Within LB encoding unit 28A, one encoding method is selected when the audio data includes speech content, and another encoding method is selected when the audio data includes music content. The same is true within HB encoding unit 28B. SPMU classifier 26 provides control input to LB encoding unit 28A and HB encoding unit 28B indicating which coding method should be selected within each of LB encoding unit 28A and HB encoding unit 28B. Audio encoder 20 may also communicate the selected encoding method to audio decoder 30 such that audio decoder 30 may select the corresponding LB and HB decoding methods to decode the encoded audio data.

The operation of a SPMU classifier in the EVS codec is described in more detail in Malenovsky, et al., "Two-Stage Speech/Music Classifier with Decision Smoothing and Sharpening in the EVS Codec," $40^{th}$ IEEE International Conference on Acoustics, Speech and Signal Processing (ICASSP) 2015, Brisbane. Australia, 19-24 Apr. 2015. The operation of a SPMU classifier in a selectable mode vocoder (SMV) is described in more detail in Song, et al., "Analyasis and Improvement of Speech/Music Classification for 3GPP2 SMV Based on GMM," IEEE Signal Processing Letters, Vol. 15, 2008.

In case that SPMU classifier 26 classifies input audio data as music content, the best quality audio encoding may be achieved using transform domain coding techniques. If, however, conventional noise suppression is applied to music signals of the audio data during pre-processing, distortions may be introduced to the music signals by the aggressive level of noise suppression. The distorted music signals may cause SPMU classifier 26 to misclassify the input audio data as speech content. Audio encoder 20 may then select a less than ideal encoding method for the input audio data, which will reduce the quality of the music signals at the output of audio decoder 30. Furthermore, even if SPMU classifier 26 is able to properly classify the input audio data as music content, the selected encoding method will encode distorted musical signals, which will also reduce the quality of the music signals at the output of audio decoder 30.

This disclosure describes techniques for performing adaptive noise suppression to improve handling of both speech signals and music signals at least up to SWB bandwidths. In some examples, the adaptive noise suppression techniques may be used to change a level of noise suppression applied to audio data during a phone call based on changes to a context or environment in which the audio data is captured.

In the illustrated example of FIG. 1, noise suppression unit 24 within audio pre-processor 22 of source device 12 is configured to identify a valid music context for audio data captured by microphones 18. In the case of the valid music context, noise suppression unit 24 may be further configured apply a low level or no noise suppression to the audio data to allow music signals of the captured audio data to pass through noise suppression unit 24 with minimal distortion and enable audio encoder 20, which is configured to operate according to the EVS codec, to properly encode the music signals. In addition, in the case of a valid speech context, noise suppression unit 24 may be configured to handle speech signals in high noise environments similar to conventional noise suppression techniques by applying an aggressive or high level of noise suppression and presenting clean speech signals to audio encoder 20.

The devices, apparatuses, systems and methods disclosed herein may be applied to a variety of computing devices. Examples of computing devices include mobile phones, cellular phones, smart phones, headphones, video cameras, audio players (e.g., Moving Picture Experts Group-1 (MPEG-1) or MPEG-2 Audio Layer 3 (MP3) players), video players, audio recorders, desktop computers/laptop computers, personal digital assistants (PDAs), gaming systems, etc. One kind of computing device is a communication device, which may communicate with another device. Examples of communication devices include mobile phones, laptop computers, desktop computers, cellular phones, smart phones, e-readers, tablet devices, gaming systems, etc.

A computing device or communication device may operate in accordance with certain industry standards, such as International Telecommunication Union (ITU) standards or Institute of Electrical and Computing Engineers (IEEE) standards (e.g., Wireless Fidelity or "Wi-Fi" standards such as 802.11a, 802.11b, 802.11g, 802.11n or 802.11ac). Other examples of standards that a communication device may comply with include IEEE 802.16 (e.g., Worldwide Interoperability for Microwave Access or "WiMAX"), Third Generation Partnership Project (3GPP), 3GPP Long Term Evolution (LTE), Global System for Mobile Telecommunications (GSM) and others (where a communication device may be referred to as a User Equipment (UE), NodeB, evolved NodeB (eNB), mobile device, mobile station, subscriber station, remote station, access terminal, mobile terminal, terminal, user terminal, subscriber unit, etc., for example). While some of the devices, apparatuses, systems and methods disclosed herein may be described in terms of one or more standards, the techniques should not be limited to the scope of the disclosure, as the devices, apparatuses, systems and methods may be applicable to many systems and standards.

It should be noted that some communication devices may communicate wirelessly or may communicate using a wired connection or link. For example, some communication devices may communicate with other devices using an Ethernet protocol. The devices, apparatuses, systems and methods disclosed herein may be applied to communication devices that communicate wirelessly or that communicate using a wired connection or link.

Figure 2:
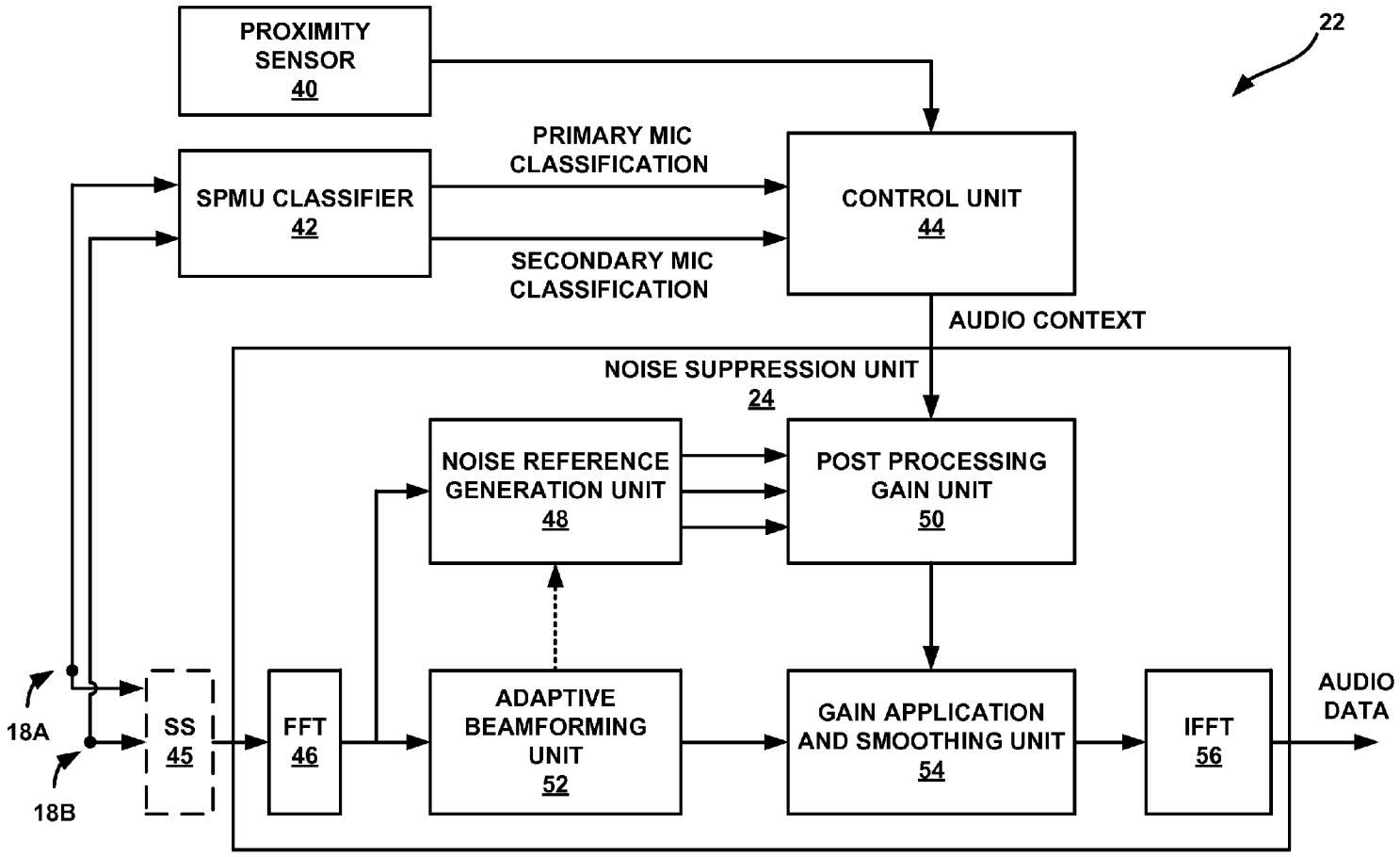
FIG. 2 is a block diagram illustrating an example of an audio pre-processor of a source device that may implement techniques described in this disclosure.

FIG. 2 is a block diagram illustrating an example of audio pre-processor 22 of source device 12 that may implement techniques described in this disclosure. In the example of FIG. 2, audio pre-processor 22 includes noise suppression unit 24, a proximity sensor 40, a speech-music (SPMU) classifier 42, sound separation (SS) unit 45, and control unit 44. Noise suppression unit 24 further includes a Fast Fourier Transform (FFT) 46, a noise reference generation unit 48, a post processing gain unit 50, an adaptive beamforming unit 52, a gain application and smoothing unit 54, and an inverse FFT (IFFT) 56.

The illustrated example of FIG. 2 includes dual microphones 18A, 188B used to capture speech, music, and noise signals at source device 12. Dual microphones 18A, 18B comprise two of microphones 18 from FIG. 1. Dual microphones 18A, 18B, therefore, may comprise two microphones in an array of microphones located external to source device 12. In the case where source device 12 comprises a mobile phone, primary microphone 18A may be a "front" microphone of the mobile phone, and secondary microphone 18B may be a "back" microphone of the mobile phone. The audio data captured by dual microphones 18A, 18B is input to pre-processor 22.

In some examples, SS unit 45 may receive the audio data captured by dual microphones 18A, 18B prior to feeding the audio data to noise suppression unit 24. SS unit 45 comprises a sound separation unit that separates out speech from noise included in the input audio data, and places the speech (plus a little residual noise) in one channel and places the noise (plus a little residual speech) in the other channel. In a dual microphone system illustrated in FIG. 2, the noise may include all the sounds that are not classified as speech. For example, if the user of source device 12 is at a baseball game and there is yelling and people cheering and a plane flying overhead and music playing, all those sounds will be put into the "noise" channel. In a three microphone system, it may be possible to separate the music into its own channel such that there is (1) a speech channel, (2) a music channel, and (3) a noise channel that includes any remaining sounds, for example, yelling, people cheering, and the plane overhead. As the number of microphones increases, SS unit 45 may be configured with more degrees of freedom in order to separate out distinct types of sound sources of the input audio data. In some examples, each microphone in an array of microphones may correlate to one channel. In other examples, two or more microphones may capture sounds that correlate to the same channel.

Within noise suppression unit 24, the captured audio data is transformed to the frequency domain using FFT 46. For example, FFT 46 may split the input audio data into multiple frequency bands for processing at each of the frequency bands. For example, each frequency band or bin of FFT 46 may include the noise spectrum in one of the channels in the frequency domain and the speech spectrum in another one of the channels.

Adaptive beamforming unit 52 is then used to spatially separate the speech signals and noise signals in the input audio data, and generate a speech reference signal and a noise reference signal from the input audio data captured by dual microphones 18A, 18B. Adaptive beamforming unit 52 includes spatial filtering to identify the direction of speech and filter out all noise coming from other spatial sectors. Adaptive beamforming unit 52 feeds the speech reference signal to gain application and smoothing unit 54. Noise reference generation unit 48 receives the transformed audio data and the separated noise signal from adaptive beamforming unit 52. Noise reference generation unit 48 may generate one or more noise reference signals for input to post processing gain unit 50.

Post processing gain unit 50 performs further processing of the noise reference signals over multiple frequency bands to compute a gain factor for the noise reference signals. Post processing gain unit 50 then feeds the computed gain factor to gain application and smoothing unit 54. In one example, gain application and smoothing unit 54 may subtract the noise reference signals from the speech reference signal with a certain gain and smoothing in order to suppress noise in the audio data. Gain application and smoothing unit 54 then feeds the noise-suppressed signal to IFFT 56. IFFT 56 may combine the audio data split among the frequency bands into a single output signal.

The gain factor computed by post processing gain unit 50 is one main factor, among other factors, that determine how aggressive the subtraction of the noise signal will be at gain application and smoothing unit 54, and thus how aggressive noise suppression is applied to the input audio data. Gain application and smoothing unit 54 applies noise suppression to the input audio data on a per frame basis, e.g., typically every 5-40 milliseconds.

In some examples, post processing gain unit 50 may use more advanced SNR based post processing schemes. In these examples, after comparing speech reference signal, X(n,f), and noise reference signal, N(n,f), energies within separate frequency bands, post processing gain unit 50 computes an SNR value, S(n,f), corresponding to each frequency band f during each frame n, according to the following equation.

$$S(n, f) = \left[\frac{X(n, f)}{N(n, f)}\right]$$

Then, post processing gain unit 50 uses the SNR value, (n,f), to compute a gain factor, G(n,f), that is applied to the speech reference signal by gain application and smoothing unit 54 to compute the noise-suppressed signal. Y(n,f), according to the following equation.

$$Y(n,f)=G(n,f)\cdot X(n,f)$$

In the case where the input audio data is captured in a valid music context, if a low or small gain factor is applied to the speech reference signal in certain frequency bands, the music signal within the input audio data may be heavily distorted.

In the illustrated example of FIG. 2, audio pre-processor 22 includes proximity sensor 40, SPMU classifier 42, and control unit 44 running in parallel with noise suppression unit 24. In accordance with the techniques described in this disclosure, these additional modules are configured to determine a context or environment in which the input audio data is captured by dual microphones 18A, 18B, and to control post processing gain unit 50 of noise suppression unit 24 to set a level of noise suppression for the input audio data based on the determined context of the audio data.

In this way, audio pre-processor 22 of source device 12 may be configured to obtain an audio context of input audio data, prior to application of a variable level of noise suppression to the input audio data, wherein the input audio data includes speech signals, music signals, and noise signals, and apply the variable level of noise suppression to the input audio data prior to bandwidth compression of the input audio data with audio encoder 20 based on the audio context. In some cases, a first portion of the input audio data may be captured by microphone 18A, and a second portion of the input audio data may be captured by microphone 18B.

Proximity sensor 40 may be a hardware unit typically included within a mobile phone that identifies the position of the mobile phone relative to the user. Proximity sensor 40 may output a signal to control unit 44 indicating whether the mobile phone is positioned near the user's face or away from the user's face. In this way, proximity sensor 40 may aid control unit 44 in determining whether the mobile phone is oriented proximate to a mouth of the user or whether the device is oriented distally away from the mouth of the user. In some examples, when the mobile phone is rotated by a certain angle, e.g., the user is listening and not talking, the earpiece of the mobile phone may be near the user's face or ear but the front microphone may not be near the user's mouth. In this case, proximity sensor 40 may still determine that the mobile phone is oriented proximate to the user even though the mobile phone is further away from the user but positioned directly in front of the user.

For example, proximity sensor 40 may include one or more infrared (IR)-based proximity sensors to detect the presence of human skin when the mobile phone is placed near the user's face (e.g., right next to the user's cheek or ear for use as a traditional phone). Typically, mobile device perform this proximity sensing for two purposes: to reduce display power consumption by turning off a display screen backlight, and to disable a touch screen to avoid inadvertent touches by the user's cheek. In this disclosure, proximity sensor 40 may be used for yet another purpose, i.e., to control the behavior of noise suppression unit 24. In this way, proximity sensor 40 may be configured to aid control unit 44 in determining an audio context of the input audio data.

SPMU classifier 42 may be a software module executed by audio pre-processor 22 of source device 12. In this way, SPMU classifier 42 is integrated into the one or more processors of source device 12. SPMU classifier 42 may output a signal to control unit 44 classifying the input audio data as one or both of speech content or music content. For example, SPMU classifier 42 may perform audio data classification based on one or more of linear discrimination, SNR-base metrics, or Gaussian mixture modelling (GMM). SPMU classifier 42 may be run in parallel to noise suppression unit 24 with no increase in delay.

SPMU classifier 42 may be configured to provide at least two classification outputs of the input audio data. In some examples, SPMU classifier 42 may provide additional classification outputs based on a number of microphones used to capture the input audio data. In some cases, one of the at least two classification outputs is music, and another one of the at least two classification outputs is speech. According to the techniques of this disclosure, control unit 44 may control noise suppression unit 24 to adjust one gain value for the input audio data based on the one of the at least two classification outputs being music. Furthermore, control unit 44 may control noise suppression unit 24 to adjust one gain value based on the one of the at least two classification outputs being speech.

As illustrated in FIG. 2, SPMU classifier 42 may be configured to separately classify the input audio data from each of primary microphone 18A and secondary microphone 18B. In this example, SPMU classifier 42 may include two separate SPMU classifiers, one for each of dual microphones 18A, 18B. In some examples, each of the classifiers within SPMU classifier 42 may comprise a three level classifier configured to classifiy the input audio data as speech content (e.g., value 0), music content (e.g., value 1), or speech and music content (e.g., value 2). In other examples, each of the classifiers within SPMU classifier 42 may comprise an even higher number of levels to include other specific types of sounds, such as whistles, tones etc.

In general, SPMU classifiers are typically included in audio encoders configured to operate according to the EVS codec, e.g., SPMU classifier 26 of audio encoder 20 from FIG. 1. According to the techniques of this disclosure, one or more additional SPMU classifiers, e.g., SPMU classifier 42, are included within audio pre-processor 22 to classify the input audio data captured by dual microphones 18A, 18B for use by control unit 44 to determine a context of the input audio data as either a valid speech context or a valid music context. In some examples, an SPMU classifier within an EVS vocoder, e.g., SPMU classifier 26 of audio encoder 20 from FIG. 1, may be used by audio pre-processor 22 via a feedback loop instead of including the one or more additional SPMU classifiers within audio pre-processor 22.

In the example illustrated in FIG. 2, SPMU classifier 42 included in pre-processor 22 may comprise a low complexity version of a speech-music classifier. While similar to SPMU classifier 26 of audio encoder 20, which may provide a classification of speech content, music content, or speech and music content for every 20 ms frame, SPMU classifier 42 of pre-processor 22 may be configured to classify input audio data approximately every 200-500 ms. In this way, SPMU classifier 42 of pre-processor 22 may be low complexity compared to SMPU classifiers used within EVS encoders, e.g., SPMU classifier 26 of audio encoder 20 from FIG. 1.

Control unit 44 may combine the signals from both proximity sensor 40 and SPMU classifier 42 with some hysteresis to determine a context of the input audio data as one of a valid speech context (i.e., the user intends to primarily transmit speech signals to engage in a conversation with a listener) or a valid music context (i.e., the user intends to primarily transmit music signals or both music and speech signals for a listener to experience). In this way, control unit 44 may differentiate between audio data captured with environmental, background, or ambient noise to be suppressed, and audio data captured in a valid music context in which the music signals should be retained encoded to recreate the rich audio scene. Control unit 44 feeds the determined audio context to post processing gain unit 50 of noise suppression unit 24. In this way, control unit 44 may be integrated into the one or more processors of source device 12 and configured to determine the audio context of the input audio data when the one or more processors are configured to obtain the audio context of the input audio data.

In some examples, the audio context determined by control unit 44 may act as an override of a default level of noise suppression, e.g., post processing gain, G(n,f), that is used to generate the noise-suppressed signal within noise suppression unit 24. For example, if a valid music context is identified by control unit 44, the post processing gain may be modified, among other changes within noise suppression unit 24, to set a less aggressive level of noise suppression in order to preserve SWB or FB music quality. One example technique is to modify the post processing gain, G(n,f), based on the identified audio context, according to the following equation.

$$G_{mod}(n,f)=G(n,f)\cdot M(n)$$

In the above equation, M(n) is derived by control unit 44 and denotes a degree to which the input audio data can be considered to have a valid music context.

In the example noise suppression configuration of FIG. 2, post processing gain is described as the main factor that is changed to modify the level of noise suppression applied to input audio data. In other examples, several other parameters used in noise suppression may be changed in order to modify the level of noise suppression applied to favor high music quality. For example, in addition to modifying post processing gain, G(n,f), other changes within noise suppression unit 24 may be performed based on the determined audio context. The other changes may include modification of certain thresholds used by various components of noise suppression unit 24, such as noise reference generation unit 48 or other component not illustrated in FIG. 2 including a voice activity detection unit, a spectral difference evaluation unit, a masking unit, a spectral flatness estimation unit, a voice activity detection (VAD) based residual noise suppression unit, etc.

In the case where control unit 44 determines that the input audio data was captured in a valid music context, e.g., a music signal is detected in primary microphone 18A and the mobile phone is away from the user's face, noise suppression unit 24 may temporarily set a less aggressive level of noise suppression to allow music signals of the audio data to pass through noise suppression unit 24 with minimal distortion. Noise suppression unit 24 may then fall back to a default, aggressive level of noise suppression when control unit 44 again determines that the input audio data has a valid speech context, e.g., a speech signal is detected in primary microphone 18A or the mobile phone is proximate to the user's face.

In some examples, noise suppression unit 24 may store a set of default noise suppression parameters for the aggressive level of noise suppression, and other sets of noise suppression parameters for one or more less aggressive levels of noise suppression. In some examples, the default aggressive level of noise suppression may be overridden for a limited period of time based on user input. This example is described in more detail with respect to FIG. 3.

In this way, gain application and smoothing unit 54 may be configured to attenuate the input audio data by one level when the audio context of the input audio data is music and attenuate the input audio data by a different level when the audio context of the input audio data is speech. In one example, a first level of attenuation of the input audio data when the audio context of the input audio data is speech in a first audio frame may be within fifteen percent of a second level of attenuation of the input audio data when the audio context of the input audio data is music in a second audio frame. In this example, the first frame may be within fifty audio frames before or after the second audio frame. In some cases, noise suppression unit 24 may be referred to a noise suppressor, and gain application and smoothing unit 54 may be referred to as a gain adjuster within the noise suppressor.

In a first example use case, a user of the mobile phone may be talking during a phone call in an environment with loud noise and music (e.g., a noisy bar, a party, or on the street). In this case, proximity sensor 40 detects that the mobile phone is positioned near the user's face, and SPMU classifier 42 determines that the input audio data from primary microphone 18A includes high speech content with a high level of noise and music content, and that the input audio data from a secondary microphone 18B has a high level of noise and music content and possibly some speech content similar to babble noise. In this case, control unit 44 may determine that the context of the input audio data is the valid speech context, and control noise suppression unit 24 to set an aggressive level of noise suppression for application to the input audio data.

In a second example use case, a user of the mobile phone may be listening during a phone call in an environment with loud noise and music. In this case, proximity sensor 40 detects that the mobile phone is positioned near the user's face, and SPMU classifier 42 determines that the input audio data from primary microphone 18A includes high noise and music content with no speech content, and that the input audio data from secondary microphone 18B includes similar content. In this case, even though the input audio data includes no speech content, control unit 44 may use the proximity of the mobile device to the user's face to determine that the context of the input audio data is the valid speech context, and control noise suppression unit 24 to set an aggressive level of noise suppression for application to the input audio data.

In a third example use case, a user may be holding the mobile phone up in the air or away from the user's face in an environment with music and little or no noise (e.g., to capture someone singing or playing an instrument in a home setting or concert hall). In this case, proximity sensor 40 detects that the mobile phone is positioned away from the user's face, and SPMU classifier 42 determines that the input audio data from primary microphone 18A includes high music content and that the input audio data from secondary microphone 18B also includes some music content. In this case, based on the absence of background noise, control unit 44 may determine that the context of the input audio data is the valid music context, and control noise suppression unit 24 to set a low level of noise suppression or no noise suppression for application to the input audio data.

In a fourth example use case, a user may be holding the mobile phone up in the air or away from the user's face in an environment with loud noise and music (e.g., to capture music played in a noisy bar, a party, or an outdoor concert). In this case, proximity sensor 40 detects that the mobile phone is positioned away from the user's face, and SPMU classifier 42 determines that the input audio data from primary microphone 18A includes a high level of noise and music content and that the input audio data from secondary microphone 18B includes similar content. In this case, even though background noise is present, control unit 44 may use the absence of speech content in the input audio data and the position of the mobile device away from the user's face to determine that the context of the input audio data is the valid music context, and control noise suppression unit 24 to set a low level of noise suppression or no noise suppression for application to the input audio data.

In a fifth example use case, a user may be recording someone singing along to music in an environment with little or no noise (e.g., to capture singing and Karaoke music in a home or private booth setting). In this case, proximity sensor 40 detects that the mobile phone is positioned away from the user's face, and SPMU classifier 42 determines that the input audio data from primary microphone 18A includes high music content and that the input audio data from secondary microphone 18B includes some music content. In this case, control unit 44 may determine that the context of the input audio data is the valid music context, and control noise suppression unit 24 to set a low level of noise suppression or no noise suppression for application to the input audio data. In some example, described in more detail with respect to FIG. 3, control unit 44 may receive additional input signals directly from a Karaoke machine to further improve the audio context determination performed by control unit 44.

In a sixth example use case, a user may be recording someone singing along to music in an environment with loud noise (e.g., to capture singing and Karaoke music in a party or bar setting). In this case, proximity sensor 40 detects that the mobile phone is positioned away from the user's face, and SPMU classifier 42 determines that the input audio data from primary microphone 18A includes high noise and music content and that the input audio data from secondary microphone 18B includes similar content. In this case, even though background noise is present, control unit 44 may use a combination of multiple indicators, such as the absence of speech content in the input audio data, the position of the mobile device away from the user's face, control signals given by a Karaoke machine, or control signals given by a wearable device worn by the user, to determine that the context of the input audio data is the valid music context, and control the noise suppression unit 24 to set a low level of noise suppression or no noise suppression for application to the input audio data.

In general, according to the techniques of this disclosure, when control unit 44 determines that the context of the input audio data is a valid music context, a level of noise suppression is applied to the input audio data that is more favorable to retaining the quality of music signals included in the input audio data. Conversely, when control unit 44 determines that the context of the input audio data is a valid speech context, a default, aggressive level of noise suppression is applied to the input audio data in order to highly suppress background noise (including music).

As one example, different levels of noise suppression in dB may be mapped as follows: an aggressive or high level of noise suppression may be greater than approximately 15 dB, a mid-level of noise suppression may range from approximately 10 dB to approximately 15 dB, and a low-level of noise suppression may range from no noise suppression (i.e., 0 dB) to approximately 10 dB. It should be noted that the provided values are merely examples and should not be construed as limiting.

Figure 3:
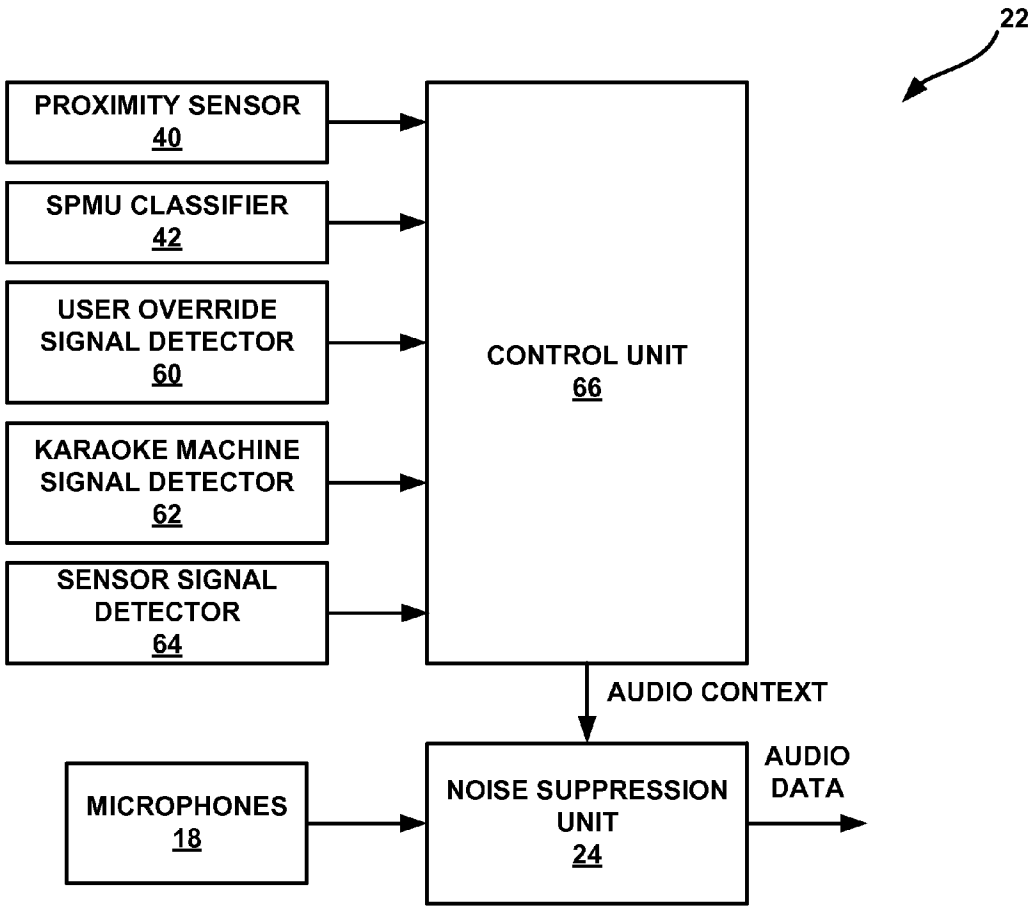
FIG. 3 is a block diagram illustrating an alternative example of an audio pre-processor of a source device that may implement techniques described in this disclosure.

FIG. 3 is a block diagram illustrating an alternative example of an audio pre-processor 22 of source device 12 that may implement techniques described in this disclosure. In the example of FIG. 3, audio pre-processor 22 includes noise suppression unit 24, proximity sensor 40, SPMU classifier 42, a user override signal detector 60, a karaoke machine signal detector 62, a sensor signal detector 64, and control unit 66. Noise suppression unit 24 may operate as described above with respect to FIG. 2. Control unit 66 may operate substantially similar to control unit 44 from FIG. 2, but may analyze additional signals detected from one or more external devices to determine the context of audio data received from microphones 18.

As illustrated in FIG. 3, control unit 44 receives input from one or more of proximity sensor 40, SPMU classifier 42, user override signal detector 60, karaoke machine signal detector 62, and sensor signal detector 64. User override signal detector 60 may detect the selection of a user override for noise suppression in source device 12. For example, a user of source device 12 may be aware that the context of the audio data captured by microphones 18 is a valid music context, and may select a setting in source device 12 to override a default level of noise suppression. The default level of noise suppression may be an aggressive level of noise suppression appropriate for a valid speech context. By selecting the override setting, the user may specifically request that a less aggressive level of noise suppression, or no noise suppression, be applied to the captured audio data by noise suppression unit 24.

Based on the detected user override signal, control unit 66 may determine that the audio data currently captured by microphones 18 has a valid music context and control noise suppression unit 24 to set a lower level of noise suppression for the audio data. In some examples, the override setting may be set to expire automatically within a predetermined period of time such that noise suppression unit 24 returns to the default level of noise suppression, i.e., an aggressive level of noise suppression. Without this override timeout, the user may neglect to disable or unselect the override setting. In this case, noise suppression unit 24 may continue to apply the less aggressive noise suppression, or no noise suppression, to all received audio signals, which may result in degraded or low quality speech signals when captured in a noisy environment.

Karaoke machine signal detector 62 may detect a signal from an external Karaoke machine in communication with source device 12. The detected signal may indicate that the Karaoke machine is playing music while microphones 18 of source device 12 are recording vocal singing by a user. The signal detected by Karaoke machine signal detector 62 may be used to override a default level of noise suppression, i.e., an aggressive level of noise suppression. Based on the detected Karaoke machine signal, control unit 66 may determine that the audio data currently captured by microphones 18 has a valid music context and control noise suppression unit 24 to set a lower level of noise suppression for the audio data to avoid music distortion while source device 12 is used to record the user's vocal singing.

Karaoke is a common example of a valid music context in which music played by a Karaoke machine and vocal singing by a user both need to be recorded for later playback or transmission to a receiver end device, e.g., destination device 14 from FIG. 1, to share among friends without distortion. Conventionally, however, sharing a high quality recording of Karaoke music with vocal signing was not possible using a wireless communication device, such as a mobile phone, due to limitations in traditional speech codecs such as adaptive multi-rate (AMR) or adaptive multi-rate wideband (AMRWB). In accordance with the techniques of this disclosure, the use of an EVS codec for audio encoder 20 and a determination of a valid music context by control unit 66 (e.g., as a result of a direct override signal detected from a Karaoke machine) a user's Karaoke sharing experience over mobile phones may be greatly improved.

In addition, sensor signal detector 64 may detect signals from one or more external sensors, such as a wearable device, in communication with source device 12. As an example, the wearable device may be a device worn by a user on his or her body, such as a smart watch, a smart necklace, a fitness tracker, etc., and the detected signal may indicate that the user is dancing. Based on the detected sensor signal along with input from one or both of proximity sensor 40 and SPMU classifier 42, control unit 66 may determine that the audio data currently captured by microphones 18 has a valid music context and control noise suppression unit 24 to set a lower level of noise suppression for the audio data. In other examples, sensor signal detector 64 may detect signals from other external sensors or control unit 66 may receive input from additional detectors to further improve the audio context determination performed by control unit 66.

Figure 4:
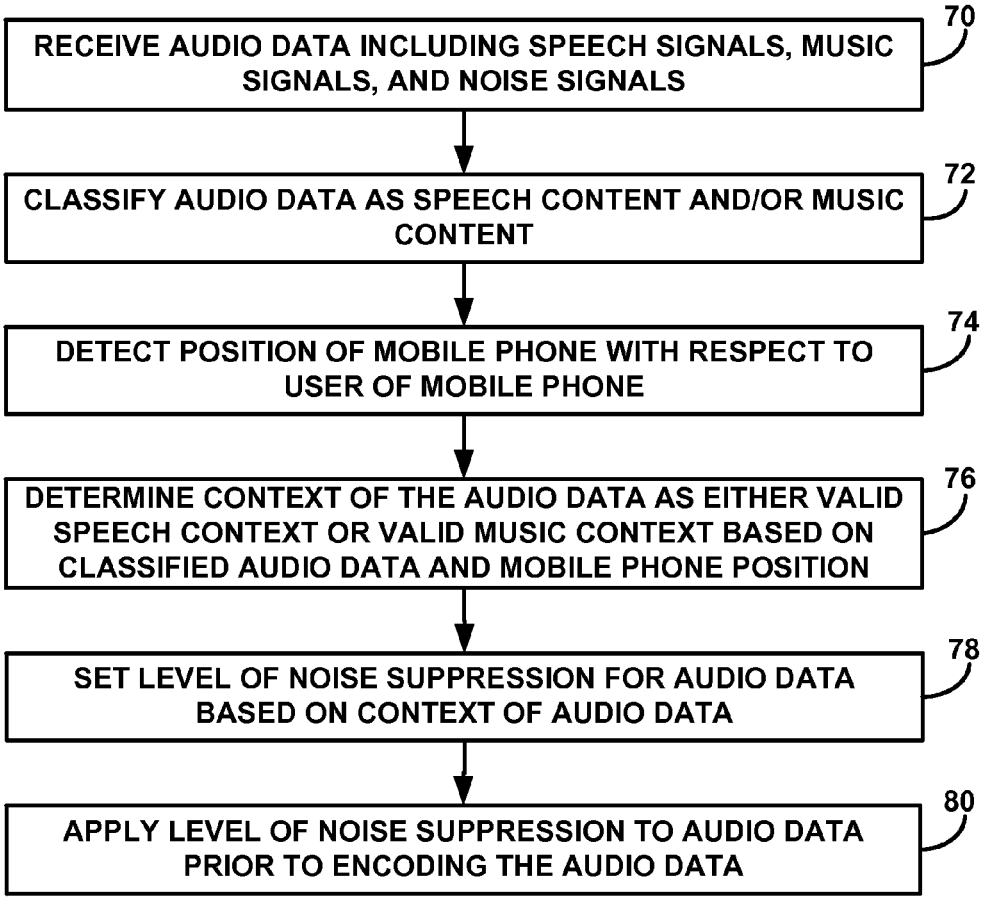
FIG. 4 is a flowchart illustrating an example operation of an audio pre-processor configured to perform adaptive noise suppression, in according with techniques described in this disclosure.

FIG. 4 is a flowchart illustrating an example operation of an audio pre-processor configured to perform adaptive noise suppression, in according with techniques described in this disclosure. The example operation of FIG. 4 is described with respect audio pre-processor 22 of source device 12 from FIGS. 1 and 2. In this example, source device 12 is described as being a mobile phone.

According to the disclosed techniques, an operation used in voice and data communications comprises obtaining an audio context of input audio data, during a conversation between a user of a source device and a user of a destination device, wherein music is playing in a background of the user of the source device, prior to application of a variable level of noise suppression to the input audio data from the user of the source device, and wherein the input audio data includes a voice of the user of the source device and the music playing in the background of the user of the source device; applying a variable level of noise suppression to the input audio data prior to bandwidth compression of the input audio data with an audio encoder based on the audio context including the audio context being speech or music, or both speech and music; bandwidth compressing the input audio data to generate at least one audio encoder packet; and transmitting the at least one audio encoder packet over the air from the source device to the destination device. The individual steps of the operation used in voice and data communications are described in more detail below.

Audio pre-processor 22 receives audio data including speech signals, music signals, and noise signals from microphones 18 (70). As described above, microphones 18 may include dual microphones with a primary microphone 18A being a "front" microphone positioned on a front side of the mobile phone near a user's mouth and secondary microphone 18B being a "back" microphone positioned at a back side of the mobile phone.

SPMU classifier 42 of audio pre-processor 22 classifies the received audio data as speech content, music content, or both speech and music content (72). As described above, SPMU classifier 42 may perform signal classification based on one or more of linear discrimination, SNR-base metrics, or Gaussian mixture modelling (GMM). For example, SPMU classifier 42 may classify the audio data captured by primary microphone 18A as speech content, music content, or both speech and music content, and feed the audio data classification for primary microphone 18A to control unit 44. In addition, SPMU classifier 42 may also classify the audio data captured by second microphone 18B as speech content, music content, or both speech and music content, and feed the audio data classification for secondary microphone 18B to control unit 44.

Proximity sensor 40 detects a position of the mobile phone with respect to a user of the mobile phone (74). As described above, proximity sensor 40 may detect whether the mobile phone is being held near the user's face or being held away from the user's face. Conventionally, proximity sensor 40 within the mobile device may typically be used to determine when to disable a touch screen of the mobile device to avoid inadvertent activation by a user's cheek during use as a traditional phone. According to the techniques of this disclosure, proximity sensor 40 may detect whether the mobile phone is being held near the user's face to capture the user's speech during use as a traditional phone, or whether the mobile phone is being held away from the user's face to capture music or speech from multiple people during use as a speaker phone.

Control unit 44 of audio pre-processor 22 determines the context of the audio data as either a valid speech context or a valid music context based on the classified audio data and the position of the mobile phone (76). In general, the type of content that is captured by primary microphone 18A and the position of the mobile phone may indicate whether the user intends to primarily transmit speech signals or music signals to a listener at a receiver side device, e.g., destination device 14 from FIG. 1. For example, control unit 44 may determine that the context of the captured audio data is the valid speech context based on at least one of the audio data captured by primary microphone 18A being classified as speech content by SPMU classifier 42 or the mobile phone being detected as positioned proximate to the user's face by proximity sensor 40. As another example, control unit 44 may determine that the context of the captured audio data is the valid music context based on the audio data captured by primary microphone 18A being classified as music content by SPMU classifier 42 and the mobile phone being detected as positioned away from a user's face by proximity sensor 40.

In this way, audio pre-processor 22 obtains the audio context of the input audio data during a conversation between the user of source device 12 and a user of destination device 14, where music is playing in a background of the user of source device 12. Audio pre-processor 22 obtains the audio context prior to application of a variable level of noise suppression to the input audio data from the user of source device 12. The input audio data includes both a voice of the user of source device 12 and the music playing in the background of the user of source device 12. In some cases, the music playing in the background of the user of source device 12 comes from a karaoke machine.

In some examples, audio pre-processor 22 obtains the audio context of the input audio data based on SPMU classifier 42 classifying the input audio data as speech, music, or both speech and music. SPMU classifier 42 may classify the input audio data as music at least eighty percent of the time that music is present with speech. In other examples, audio pre-processor 22 obtains the audio context of the input audio data based on proximity sensor 40 determining whether source device 12 is proximate to or distally away from a mouth of the user of source device 12 based on a position of the source device. In one example, pre-processor 22 obtain the audio context based on the user of source device 12 wearing a smart watch or other wearable device.

Control unit 44 feeds the determined audio context of the captured audio data to noise suppression unit 24 of audio pre-processor 22. Noise suppression unit 24 then sets a level of noise suppression for the captured audio data based on the determined audio context of the audio data (78). As described above, noise suppression unit 24 may set the level of noise suppression for the captured audio data by modifying a gain value based on the determined context of the audio data. More specifically, noise suppression unit 24 may increase a post processing gain value based on the context of the audio data being the valid music context in order to reduce the level of noise suppression for the audio data.

In the case that the context of the audio data is the valid speech context, noise suppression unit 24 may set a first level of noise suppression that is relatively aggressive in order to suppress noise signals (including music signals) and clean-up speech signals in the audio data. In the case that the context of the audio data is the valid music context, noise suppression unit 24 may set a second level of noise suppression that is less aggressive to leave music signals undistorted in the audio data. In the above example, the second level of noise suppression is lower than the first level of noise suppression. For example, the second level of noise suppression may be at least 50 percent lower than the first level of noise suppression. More specifically, in some examples, an aggressive or high level of noise suppression may be greater than approximately 15 dB, a mid-level of noise suppression may range from approximately 10 dB to approximately 15 dB, and a low-level of noise suppression may range from no noise suppression (i.e., 0 dB) to approximately 10 dB.

Noise suppression unit 24 then applies the level of noise suppression to the audio data prior to sending the audio data to an EVS vocoder for bandwidth compression or encoding (80). For example, audio encoder 20 from FIG. 1 may be configured to operate according to the EVS codec that is capable of properly encoding both speech and music signals. The techniques of this disclosure, therefore, enable a complete, high-quality recreation of the captured audio scene at a receiver side device, e.g., destination device 14 from FIG. 1, with minimal distortions to SWB music signals.

In this way, audio pre-processor 22 applies a variable level of noise suppression to the input audio data prior to bandwidth compression of the input audio data by audio encoder 20 based on the audio context including the audio context being speech or music, or both speech and music. Audio encoder 20 then bandwidth compresses the input audio data to generate at least one audio encoder packet; and source device 12 transmits the at least one audio encoder packet over the air from source device 12 to destination device 14.

In some examples, audio pre-processor 22 adjusts a noise suppression gain so that there is one attenuation level of the input audio data when the audio context of the input audio data is music and there is a different attenuation level of the input audio data when the audio context of the input audio data is speech. In one case, the one attenuation level and the different attenuation level both have the same value. In that case, the music playing in the background of the user of source device 12 passes through noise suppression unit 24 at the same attenuation level as the voice of the user of source device 12.

A first level of attenuation of the input audio data may be applied when the user of source device 12 is talking at least 3 dB louder than the music playing in the background of the user of source device 12, and a second level of attenuation of the input audio data may be applied when the music playing in the background of the user of source device 12 is at least 3 dB louder than the talking of the user of source device 12. The bandwidth compression of the input audio data of the voice of the user of source device 12 and the music playing in the background of the user of source device 12 at the same time may provide at least 30% less distortion of the music playing in the background as compared to bandwidth compression of the input audio data of the voice of the user of source device 12 and the music playing in the background of the user of source device 12 at the same time without obtaining the audio context of the input audio data prior to application of noise suppression to the input audio data.

Any use of the term "and/or" throughout this disclosure should be understood to refer to either one or both. In other words, A and/or B should be understood to provide for either (A and B) or (A or B).

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code, or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless communication device, a wireless handset, a mobile phone, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software or firmware.

Various embodiments of the invention have been described. These and other embodiments are within the scope of the following claims.

What is claimed is:

1. A device configured to provide voice and data communications, the device comprising:

one or more processors configured to:

classify primary input audio data, by a classifier, from a primary microphone and output a primary microphone classification of the primary input audio data;

classify secondary input audio data, by the classifier, from a secondary microphone and output a secondary microphone classification of the secondary input audio data;

obtain a proximity signal that determines the device's relative position to a user;

obtain an audio context, with a control unit, of the primary input audio data and the secondary input audio data, wherein the control unit combines the proximity signal, the primary microphone classification, and the secondary microphone classification output by the classifier, prior to application of a variable level of noise suppression to the primary input audio data and the secondary input audio data, wherein the primary input audio data and secondary input audio data includes speech signals, music signals, and noise signals and the audio context indicating a valid speech context or a valid music context;

apply, with a noise suppression unit, the variable level of noise suppression to the primary input audio data and the secondary input audio data, wherein the variable level of the noise suppression unit includes a first level of noise suppression when the speech signals are louder than the music signals, and a second level of noise suppression that is lower than the first level of the noise suppression to leave music signals undistorted in the primary input audio data and the secondary input audio data when the music signals are louder than the speech signals, and the variable noise suppression is applied to the primary input audio data and the secondary input audio data prior to bandwidth compression, by an audio encoder coupled to the noise suppression unit, to generate a noise suppressed version of the primary input audio data and the secondary input audio data; and bandwidth compress, with the audio encoder, the noise suppressed version of the primary input audio data and the secondary input audio data to generate at least one audio encoder packet;

a memory, electrically coupled to the one or more processors, configured to store the at least one audio encoder packet; and a transmitter configured to transmit the at least one audio encoder packet.

2. The device of claim 1, further comprising the primary microphone and the secondary microphone.

3. The device of claim 1 wherein a first level of attenuation of the primary input audio data and the secondary input audio data when the audio context of the input audio data indicates the valid speech context in a first audio frame is within fifteen percent of a second level of attenuation of the primary input audio data and the secondary audio data when the audio context of the primary input audio data and the secondary input audio data indicates the valid music context during a second audio frame.

4. The device of claim 3, wherein the first audio frame is within fifty audio frames before or after the second audio frame.

5. The device of claim 1, wherein the classifier is configured to provide at least two classification outputs of the primary input audio data and the secondary input audio data, and the at least two classification outputs are the primary microphone classification and the secondary microphone classification.

6. The device of claim 5, wherein the classifier is integrated into the one or more processors.

7. The device of claim 5, where one of the at least two classification outputs is the valid music context, and another one of the at least two classification outputs is a valid speech context.

8. The device of claim 7, wherein the one or more processors configured to apply the noise suppression are further configured to adjust one gain value in a noise suppressor of the device based on the one of the at least two classification outputs being the valid music context.

9. The device of claim 7, wherein the one or more processors configured to apply the variable level of noise suppression are further configured to adjust one gain value in a noise suppressor of the device based on the one of the at least two classification outputs being the valid speech context.

10. The device of claim 1, further comprising a control unit integrated into the one or more processors configured to determine the audio context of the primary input audio data and the secondary input audio data, when the one or more processors are configured to obtain the audio context of the primary input audio data and the secondary input audio data.

11. The device of claim of claim 10, further comprising a proximity sensor configured to output the proximity signal and aid the control unit to determine the audio context of the primary input audio data and the secondary input audio data.

12. The device of claim 1, wherein obtaining of the audio context is further improved based on the control unit receiving input from one or more external sensors in a wearable device, the wearable device in communication with the source device.

13. The device of claim 1, further comprising at least one speaker configured to render an output of an audio decoder configured to decode the at least one audio encoder packet from a destination device.

14. An apparatus configured to perform noise suppression comprising:

means for classifying primary input audio data, by a classifier, from a primary microphone and output a primary microphone classification of the primary input audio data;

means for classifying secondary input audio data, by the classifier, from a secondary microphone and output a secondary microphone classification of the secondary input audio data;

means for obtain a proximity signal that determines the device's relative position to a user;

means for determining an audio context, with a control unit, of the primary input audio data and the secondary input audio data, wherein the control unit combines the proximity signal and the primary microphone classification and the secondary microphone classification output by the classifier, prior to application of a variable level of noise suppression to the primary input audio data and the secondary input audio data, wherein the primary input audio data and the secondary input audio data includes speech signals, music signals, and noise signals, and the audio context indicating a valid speech context or a valid music context;

means for applying, with a noise suppression unit, the variable level of noise suppression to the primary input audio data and the secondary input audio data, wherein the variable level of the noise suppression includes a first level of noise suppression when the speech signals are louder than the music signals, and a second level of noise suppression that is lower than the first level of the noise suppression to leave music signals undistorted, in the primary input audio data and the secondary input audio data, when the music signals are louder than the speech signals, and the variable noise suppression is applied to the primary input audio data and the secondary input audio data prior to bandwidth compression, by an audio encoder coupled to the noise suppression unit, to generate a noise suppressed version of the primary input audio data and the secondary input audio data;

means for bandwidth compressing the noise suppressed version of the primary input audio data and the secondary input audio data, based on the primary microphone classification and the secondary microphone classification output by the classifier, to generate at least one audio encoder packet; and means for transmitting the at least one audio encoder packet.

15. The apparatus of claim 14, wherein the apparatus further comprises:

means for determining the audio context of the primary input audio data and the secondary input audio data is based on means for capturing a first portion of the primary input audio data from the primary microphone, wherein the primary microphone is positioned at a front of the device, and means for capturing a second portion of the secondary input audio data from the secondary microphone, wherein the secondary microphone is positioned at a back of the device.

16. The apparatus of claim 15, wherein the apparatus further comprises:

means for obtaining a user override signal for the means for applying the second level of noise suppression to the primary input audio data and the secondary input audio data.

17. The apparatus of claim 14, wherein the apparatus further comprises:

means for communicating with a different apparatus, wherein the different apparatus is wearable device or a karaoke machine.

18. A method used in voice and data communications comprising:

classifying primary input audio data, by a classifier, from a primary microphone and output a primary microphone classification of the primary input audio data;

classifying secondary input audio data, by the classifier, from a secondary microphone and output a secondary microphone classification of the secondary input audio data;

obtaining a proximity signal that determines whether the device's proximity to the user's face;

obtaining an audio context, with a control unit, of the primary input audio data and the secondary input audio data, wherein the control unit combines the proximity signal and the primary microphone classification and the secondary microphone classification output by the classifier prior to application of noise suppression to the primary input audio data and the secondary input audio data, wherein the input audio data includes speech signals, music signals, and noise signals, and the audio context indicating a valid speech context or a valid music context;

applying, with a noise suppression unit, the variable level of noise suppression to the primary input audio data and the secondary input audio data, wherein the variable level of noise suppression includes a first level of noise suppression when the speech signals are louder than the music signals, and a second level of noise suppression that is lower than the first level of the noise suppression to leave music signals undistorted, in the primary input audio data and secondary input audio data, when the music signals are louder than the speech signals, and the variable noise suppression is applied to the primary input audio data and the secondary input audio data prior to bandwidth compression, by an audio encoder coupled to the noise suppression unit, to generate a noise suppressed version of the primary input audio data and the secondary input audio data;

bandwidth compressing, with the audio encoder, the noise suppressed version of the primary input audio data and the secondary input audio data, based on the audio context, to generate at least one audio encoder packet; and transmitting the at least one audio encoder packet from a source device to a destination device.

19. The method of claim 18, wherein the first level of noise suppression and the second level of noise suppression are different when the music signals are at the same level as the speech signals.

20. The method of claim 18, wherein the first level of noise suppression of the primary input audio data and the secondary input audio data is applied when the user of the source device is talking at least 3 dB louder than the music playing in the background of the source device, and the second level of noise suppression of the primary input audio data and the secondary input audio data is applied when the music playing in the background of the source device is at least 3 dB louder than the talking of the user of the source device.

21. The method of claim 18, wherein bandwidth compression of voice in the speech signals and music playing in the background, in the primary input audio data and the secondary input audio data provides at least 30% less distortion of the music playing in the background as compared to bandwidth compression of the voice in the speech signals and music playing in the background, in the primary input audio data and the secondary input audio data of the voice without obtaining the audio context of the primary input audio data and the secondary input audio data prior to application of noise suppression to the primary input and the secondary input audio data.

22. The method of claim 1, further comprising classifying the primary input audio data and the secondary input audio data as music at least eighty percent of the time that music is present with speech.

23. The method of claim 18, wherein the obtaining of the audio context is further improved based on the control unit receiving input from one or more external sensors in a wearable device, the wearable device in communication with the source device.

24. The method of claim 18, where the music context of the user of the source device comes from a karaoke machine.

* * * * *